US009861539B1

(12) United States Patent
Stickler et al.

(10) Patent No.: US 9,861,539 B1
(45) Date of Patent: Jan. 9, 2018

(54) INFLATABLE STRETCHER WITH HEAD IMMOBILIZATION FEATURE

(71) Applicant: Evacugear LLC, Glenview, KY (US)

(72) Inventors: Larry Stickler, Glenview, KY (US); Timothy Schmitt, Greenville, IN (US); John Keesaer, Louisville, KY (US); Douglas VanMeter, Prospect, KY (US)

(73) Assignee: Evacugear LLC, Glenview, KY (US)

( * ) Notice: Subject to any disclaimer, the term of this patent is extended or adjusted under 35 U.S.C. 154(b) by 0 days.

(21) Appl. No.: 15/670,023

(22) Filed: Aug. 7, 2017

Related U.S. Application Data

(60) Provisional application No. 62/380,663, filed on Aug. 29, 2016, provisional application No. 62/455,640, filed on Feb. 7, 2017.

(51) Int. Cl.
*A61G 1/013* (2006.01)
*A61G 1/044* (2006.01)
*A61G 1/052* (2006.01)

(52) U.S. Cl.
CPC ..... *A61G 1/013* (2013.01); *A61G 1/044* (2013.01); *A61G 1/052* (2013.01)

(58) Field of Classification Search
CPC . A61G 1/00; A61G 1/01; A61G 1/013; A61G 1/04; A61G 1/044; A61G 7/05769; A61G 7/05776; A61G 7/1026; A61G 7/103; A61G 7/0005; A47C 27/081; A47C 27/10; A61F 5/37; A61F 5/3769; A61F 5/3776; A47K 3/06; A47K 3/062; A47K 3/064
USPC ..... 5/625–628, 706, 710, 713, 81.1 R, 5/81.1 HS, 81.1 T; 128/869, 870, 876; 4/585–588
See application file for complete search history.

(56) References Cited

U.S. PATENT DOCUMENTS 3,775,782 A * 12/1973 Rice ..... A61G 1/00 128/DIG. 20
RE28,916 E * 7/1976 Rice ..... A61G 1/00 5/625
4,024,861 A * 5/1977 Vincent ..... A61F 5/05883 128/870
4,067,075 A * 1/1978 Leathers ..... A61G 1/00 128/DIG. 20
4,124,908 A 11/1978 Burns
4,301,791 A 11/1981 Franco
4,466,145 A * 8/1984 Jones ..... A61G 1/00 441/40
4,621,382 A * 11/1986 Burriss ..... A61G 1/00 441/129
4,736,474 A 4/1988 Moran
4,964,183 A * 10/1990 LaForce, Jr. ..... A47C 1/14 4/538
5,060,324 A * 10/1991 Marinberg ..... A61B 6/0442 128/873
5,247,712 A * 9/1993 Williams ..... A47K 3/06 4/538
5,568,663 A * 10/1996 Brown ..... A61G 1/00 5/413 AM
5,604,945 A * 2/1997 Fisher ..... A47C 27/081 441/129

(Continued)

*Primary Examiner* — Robert G Santos
(74) *Attorney, Agent, or Firm* — Duncan Galloway Egan Greenwald LLC; Theresa Camoriano; Guillermo Camoriano

(57) ABSTRACT

An inflatable stretcher provides support and protection to a patient, including head immobilization, without interfering with the patient's face.

6 Claims, 10 Drawing Sheets

(56) References Cited

U.S. PATENT DOCUMENTS

| | | | | | |
|---|---|---|---|---|---|
| 6,053,534 | A * | 4/2000 | Timmerman | A62B 1/02 | 280/17 |
| 6,061,853 | A | 5/2000 | Laaksonen | | |
| 6,138,306 | A * | 10/2000 | Muhanna | A61G 1/00 | 128/870 |
| 6,425,399 | B1 * | 7/2002 | Hoster, Jr. | A61F 5/05816 | 128/869 |
| 6,543,068 | B1 * | 4/2003 | Penninger | A47K 3/06 | 4/585 |
| 6,964,073 | B1 * | 11/2005 | Curry | A61G 1/00 | 128/870 |
| 7,082,632 | B2 | 8/2006 | Hood | | |
| 7,774,877 | B2 * | 8/2010 | Kenalty | A61G 1/01 | 5/494 |
| 7,962,983 | B2 | 6/2011 | Keesaer | | |
| 8,365,326 | B2 * | 2/2013 | Kenalty | A61G 1/00 | 5/625 |
| 8,782,833 | B2 * | 7/2014 | Beurguet | A61G 1/01 | 128/870 |
| 2003/0106155 | A1 | 6/2003 | Arai | | |
| 2008/0301876 | A1 * | 12/2008 | Kenalty | A61G 7/0504 | 5/620 |
| 2010/0199434 | A1 * | 8/2010 | Keesaer | A61G 1/01 | 5/628 |
| 2010/0299837 | A1 | 12/2010 | Yandle | | |
| 2011/0185504 | A1 * | 8/2011 | Kenalty | A61G 1/00 | 5/626 |
| 2012/0291203 | A1 * | 11/2012 | Beurguet | A61G 1/01 | 5/706 |

* cited by examiner

INFLATABLE STRETCHER WITH HEAD IMMOBILIZATION FEATURE

This application claims priority from U.S. Provisional Application Ser. 62/380,663 filed Aug. 29, 2016, and from U.S. Provisional Application Ser. 62/455,640 filed Feb. 7, 2017, both of which are incorporated herein by reference.

BACKGROUND

The present invention relates to inflatable stretchers, and more particularly to an inflatable stretcher with a head immobilization feature.

Inflatable stretchers are known. They may be used to evacuate hospital patients or people injured in the field, such as on ski slopes, in water recreation areas, on the battlefield, and elsewhere. Inflatable stretchers have the advantage that they can be stored in a relatively small space, and yet they quickly can become rigid and provide protection to a patient even when being dragged along rough terrain, including up and down stairs. They also serve as flotation devices when deployed in water.

SUMMARY

The present invention provides an additional advantage over prior art inflatable stretchers in that it provides a head immobilization feature, which includes left and right head immobilization chambers which inflate with the rest of the inflatable stretcher and which secure with a strap that does not interfere with the patient's face or neck. A second embodiment includes ball transfer bearings to aid in the sliding of the inflatable stretcher over relatively smooth surfaces such as may be found indoors or in parking lots.

DESCRIPTION

Figure 1:
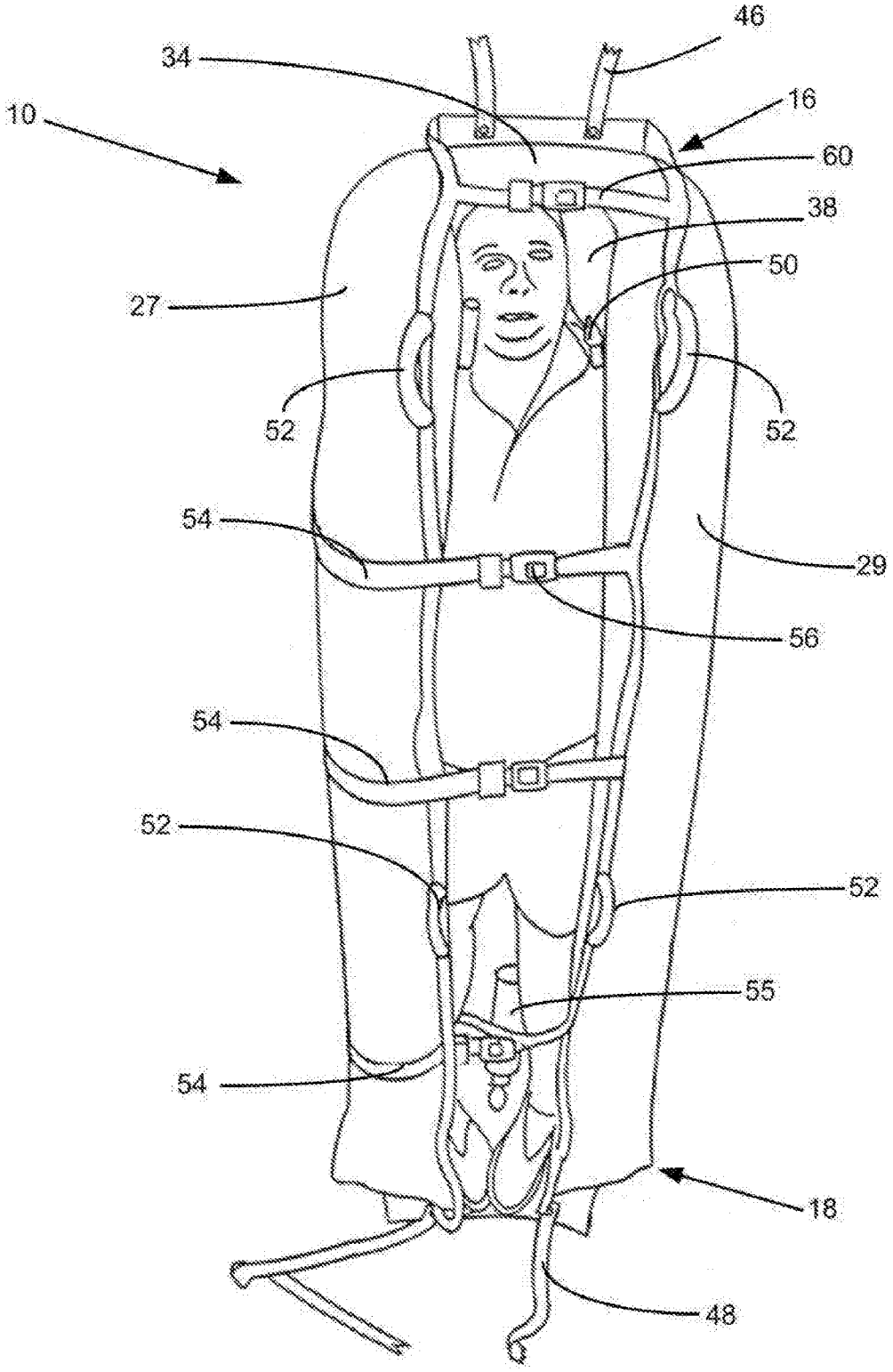
FIG. 1 is a perspective view of an inflatable stretcher with a patient secured on the inflatable stretcher.

FIGS. 1-8 show a first embodiment of an inflatable stretcher 10, which is made of an upper layer 12 and a lower layer 14 (See FIG. 4A) of a gas impermeable sheet material having a generally rectangular shape. These upper and lower layers 12, 14 are secured together along a plurality of seams and define a head end 16, a foot end 18, a left side 20, and a right side 22. In this embodiment, the layers 12, 14 are made of 1700 Denier Ballistic nylon material, and the seams are made by welding. One or two sheets 15 of ultra high molecular weight (UHMW) polyurethane (See FIGS. 4A and 4B) are placed below the lower layer 14 and are secured by stitching along the welded seams. This UHMW material provides shred and puncture resistance and provides a low friction surface which helps when dragging the stretcher 10 along the ground or other surface.

Figure 3:
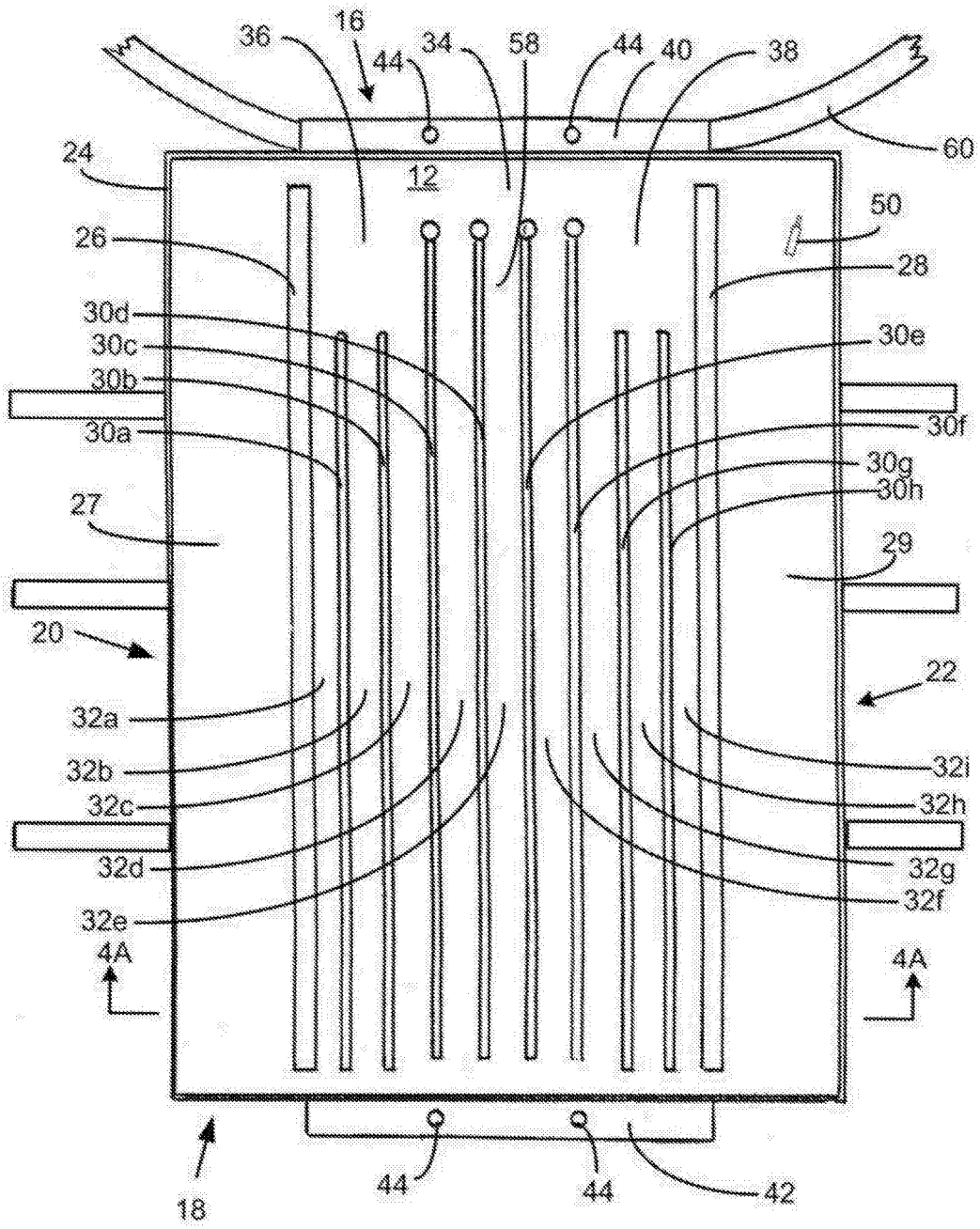
FIG. 3 is a plan view of the inflatable stretcher of FIG. 2, with the pulling straps removed.
Figure 4A:
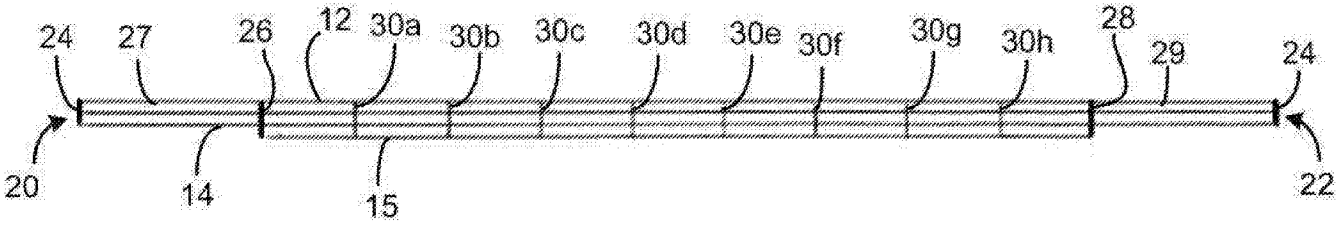
FIG. 4A is a view taken along the section 4A-4A of FIG. 3.
Figure 4B:
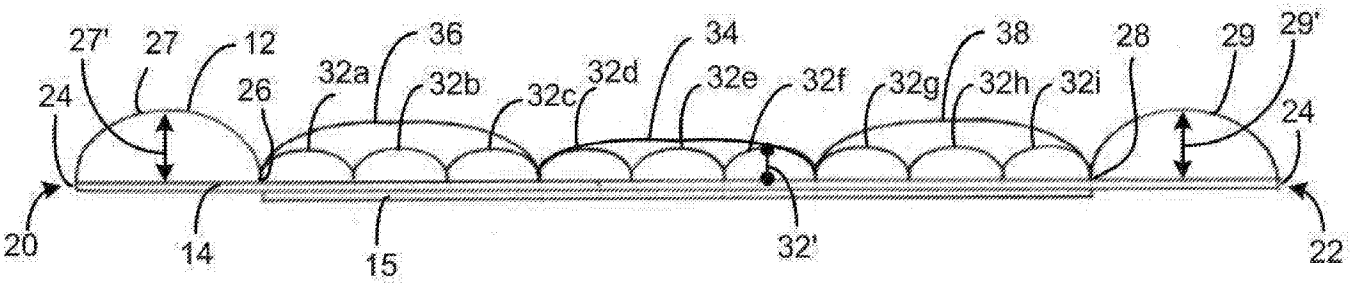
FIG. 4B is the same a FIG. 4A but with the inflatable stretcher fully inflated.

Referring briefly to FIGS. 3, 4A, and 4B, there is a perimeter seam 24 extending around the perimeter of the upper and lower sheets 12, 14. There is a left bumper seam 26 located a first distance from the left side 20 and extending in a lengthwise direction from the head end 16 to the foot end 18 to form an elongated left side bumper chamber 27. Since the stretcher 10 is symmetrical about an imaginary center line extending in the elongated direction from the head end 16 to the foot end 18, there is a corresponding right bumper seam 28 located the same first distance from the right side 22 and extending in the lengthwise direction to form an elongated right side bumper chamber 29. The left and right bumper seams 26, 28 terminate short of the perimeter seam 24 at the head and foot ends 16, 18, leaving passageways that provide fluid communication between the bumper chambers 27, 29 and the other chambers that are described below.

Interiorly of the bumper chambers 27,29 are parallel, elongated seams 30 *a-h* (see FIGS. 3 and 4A), which form parallel, elongated body support chambers 32 *a-i* (see FIGS. 3 and 4B) extending in the lengthwise direction. These elongated seams 30 *a-h* also terminate short of the perimeter seam 24 at the head and foot ends 16, 18. In this embodiment, each of the bumper chambers 27, 29 is 10.75 inches wide before inflation, and each of the body support chambers 32 *a-i* is from 3.5 inches to 4.0 inches wide before inflation. The elongated body support chambers 32 *a, b, h* and *i* are 3.5 inches wide before inflation, and the elongated body support chambers 32 *c, d, e, f,* and *g* are 4.0 inches wide before inflation. As shown in FIG. 4B, when the inflatable stretcher 10 is fully inflated, the side bumper chambers 27, 29 have a height 27', 29' (the elevation above the flat lower layer 14) of ten inches, and the body support chambers 32 *a-i* have a height 32' (see FIG. 4B) of 2¼ inches.

The four central seams 30 *c-f* terminate five inches short of the head end 16, forming a head bumper chamber 34 between the ends of the seams 30*c-f* and the perimeter seam 24 at the head end 16. The head bumper chamber 34 is 12 inches wide before inflation. When the stretcher 10 is inflated, the head bumper chamber 34 has a height of four inches. The two left body support chamber seams 30*a*, 30*b*, and the two right body support chamber seams 30*g*, 30*h* terminate 14 inches short of the perimeter seam 24 at the head end 16 and form left and right head immobilization chambers 36, 38, each of which is 11 inches wide before inflation. When inflated, the head immobilization chambers 36, 38 have a height of 6¾ inches. The portions of the three central body support chambers 32*d-f* that extend from the head bumper chamber 34 for about 7-9 inches in the elongated direction toward the foot end 18 form a central head support area 58, which has the same height as the respective body support chambers 32*d-f*. The head support area 58 is flanked on its left and right sides by the left and right head immobilization chambers 36, 38.

There are central extensions 40, 42 at the head end 16 and foot end 18, respectively, which are made up of the upper and lower layers 12, 14 extending beyond the perimeter seam 24. These extensions 40, 42 are flat (not inflated) and extend the widthwise distance from the left bumper chamber seam 26 to the right bumper chamber seam 28. Each of the extensions 40, 42 defines two through openings 44, which are reinforced with brass grommets. There is a head end pulling strap 46 (See FIG. 1) secured through the openings 44 at the head end 16 and a foot end pulling strap 48 secured through the openings 44 at the foot end 18. These pulling straps 46, 48 may be used to drag the stretcher 10.

Figure 2:
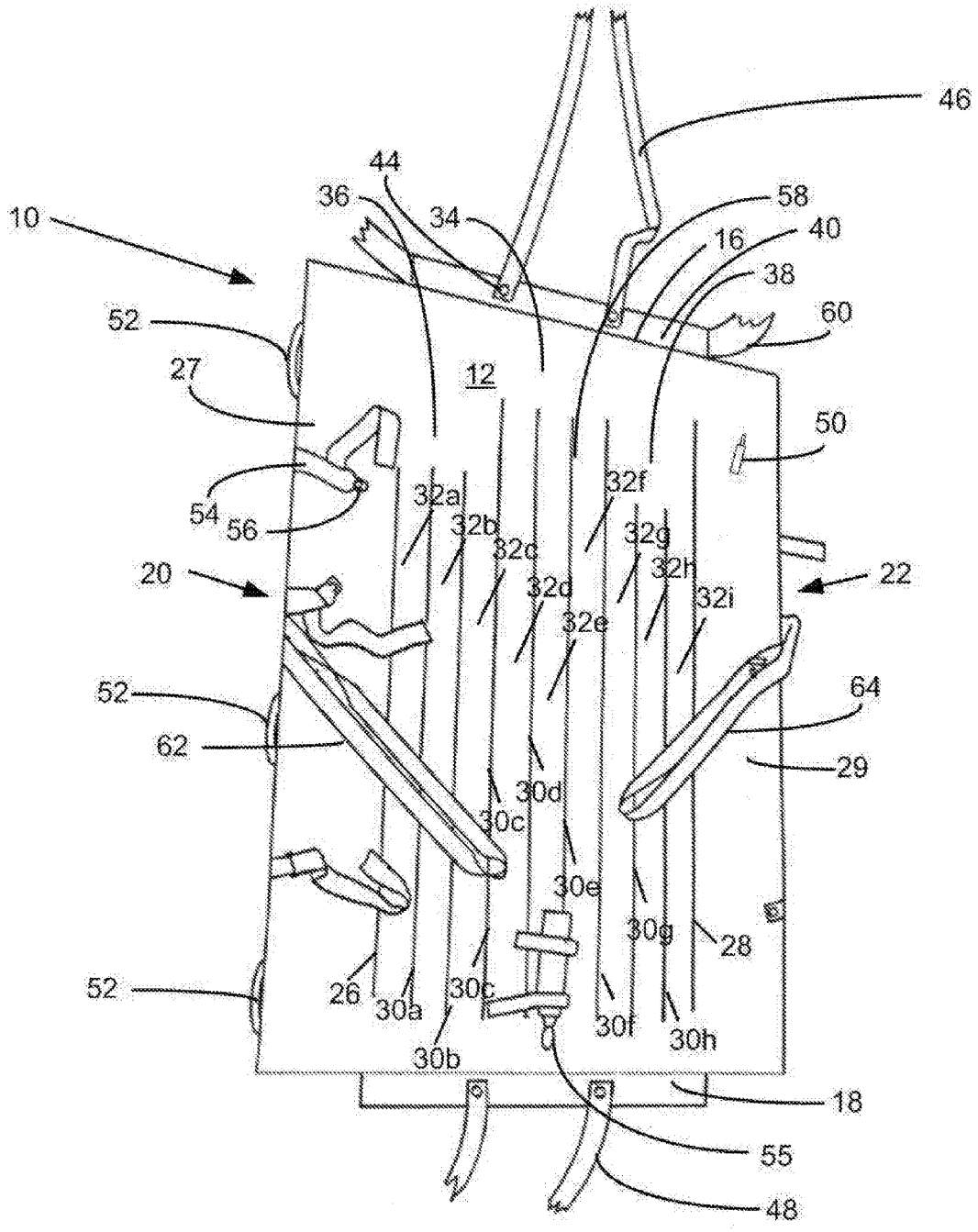
FIG. 2 is a top perspective view of the inflatable stretcher of FIG. 1 before it has been inflated.

There is a gas inlet opening 50 (See FIG. 2), which is used for inflating the inflatable stretcher 10. The stretcher 10 may be inflated by blowing into a tube connected to the gas inlet opening 50, by using a foot pump (not shown), by connecting a bottle of compressed gas 55, or by any known inflation means. In this embodiment, as shown in FIGS. 1 and 2, the bottle of compressed gas 55 is secured to the stretcher 10 by straps near the foot end 18, and the bottle 55 is readily removed and connected to the gas inlet 50 for inflating the stretcher 10. This arrangement quickly inflates the inflatable stretcher 10, in less than thirty seconds. The gas inlet 50 is in fluid communication with all the inflatable chambers, so connecting the bottle 55 to the gas inlet 50 (or injecting gas into the gas inlet 50 by other means) inflates all the inflatable chambers.

As shown in FIGS. 1, 2, 5, 6 and 8, handles 52 are secured at the left and right sides 20, 22 and may be used to pick up the stretcher 10.

Body securement straps 54 with buckles 56 are secured to the left and right sides of the stretcher 10. These straps 54 are located so they will extend across the chest, torso, and legs of a patient who is lying on the stretcher 10 with the patient's head abutting the head bumper 34. When these straps 54 are tightened, they pull the left and right side bumpers 27, 29 upwardly and together, wrapping the patient snugly inside the stretcher 10, as shown in FIG. 1.

A head securement strap 60 with a buckle is secured at the left and right ends of the extension 40, adjacent to the head ends of the bumper chamber seams 26, 28, which is adjacent to the outer edges of the head immobilization chambers 36, 38. This head securement strap 60 is located so that, when it is tightened, it pulls the head immobilization chambers 36, 38 upwardly and toward each other, pressing them against the sides of the patient's head, as shown in FIG. 1. The head securement strap 60 does not contact the patient's face or neck, as it lies beyond the head support area 58 and beyond the head bumper chamber 34 in the direction of the head end 16. This means that the head strap 60 will not bother the patient and will not interfere with an oxygen mask or other apparatus that may be used in the face area.

Various types of straps and buckles may be used. They may be like seatbelt straps and seatbelt buckles, the buckles may be made of plastic pieces that snap together, or other known types of straps and securement mechanisms may be used. It is advantageous that the straps can be tightened after a patient is placed onto the stretcher 10 and the stretcher 10 is inflated.

Leg straps 62, 64 (See FIGS. 2, 5, 6 and 7) with buckles are secured to the left and right sides 20, 22 at approximately the position of the patient's waist. These straps are placed around the patient's left and right legs, respectively, and are tightened to provide a harness to support the patient in the crotch area, and these leg straps 62, 64 would support the weight of the patient if the stretcher 10 were lifted vertically or nearly vertically from the head end 16.

Figure 5:
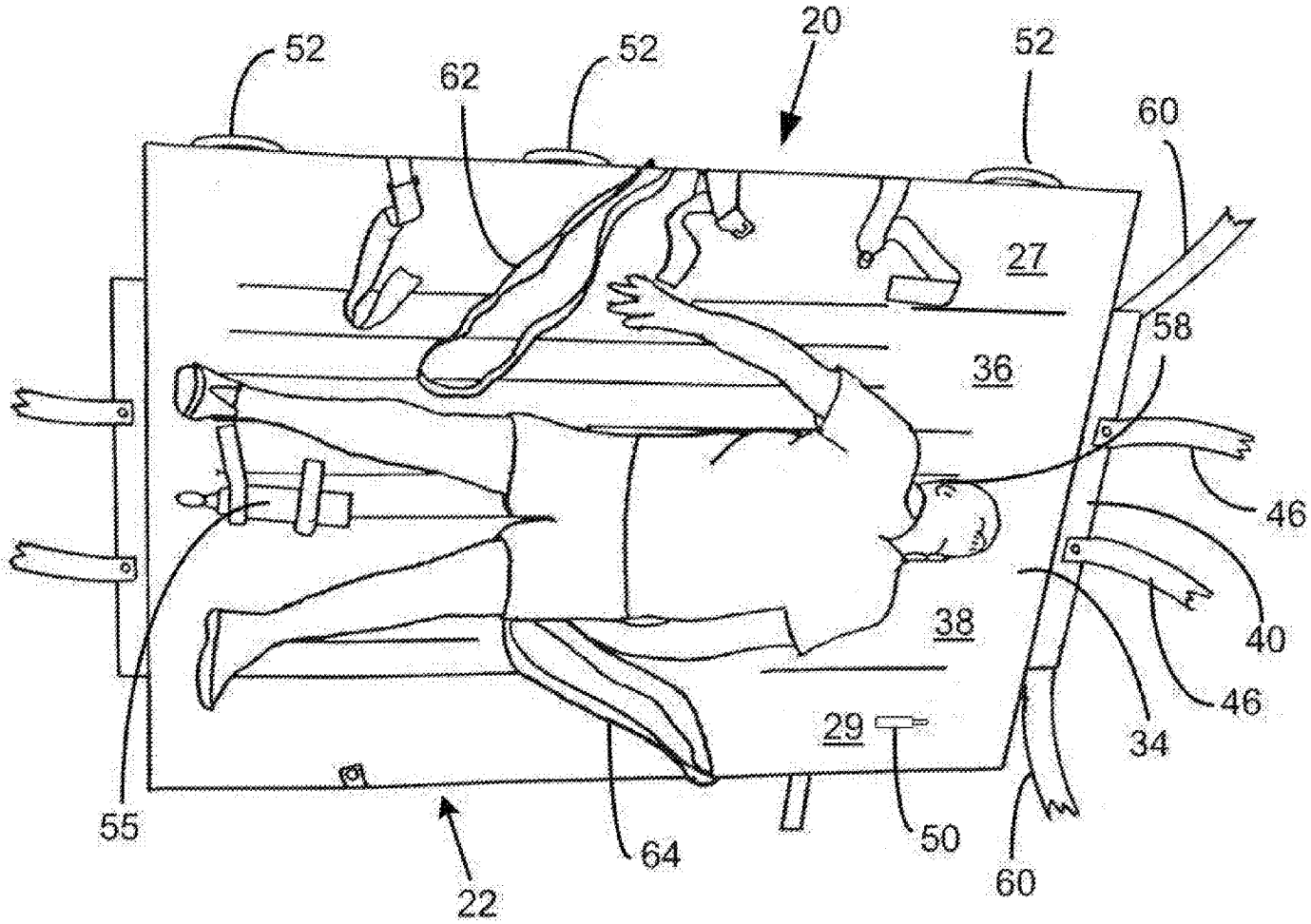
FIG. 5 is a top perspective view of the inflatable stretcher of FIG. 2 with a patient lying on the stretcher before it is inflated.
Figure 6:
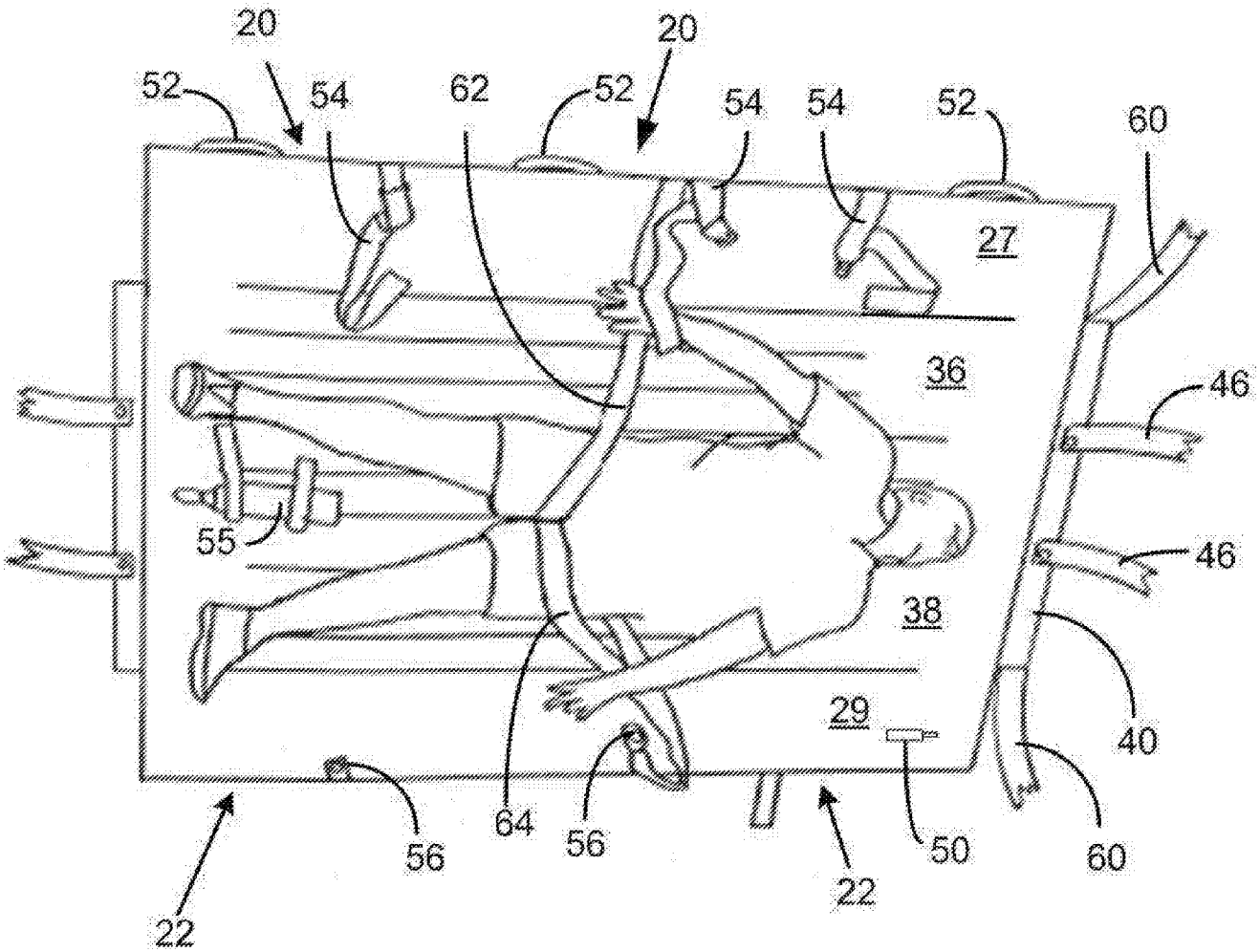
FIG. 6 is the same view as FIG. 5 but with the leg straps positioned around the patient's legs.

To Use the Inflatable Stretcher:

As shown in FIG. 2, the inflatable stretcher 10 is placed flat on the ground or other support surface. As shown in FIG. 5, the patient is placed on top of the flat, uninflated stretcher 10, with his head in the head support area 58. The leg straps 62, 64 are secured around the patient's legs by buckling as shown in FIG. 6.

Figure 7:
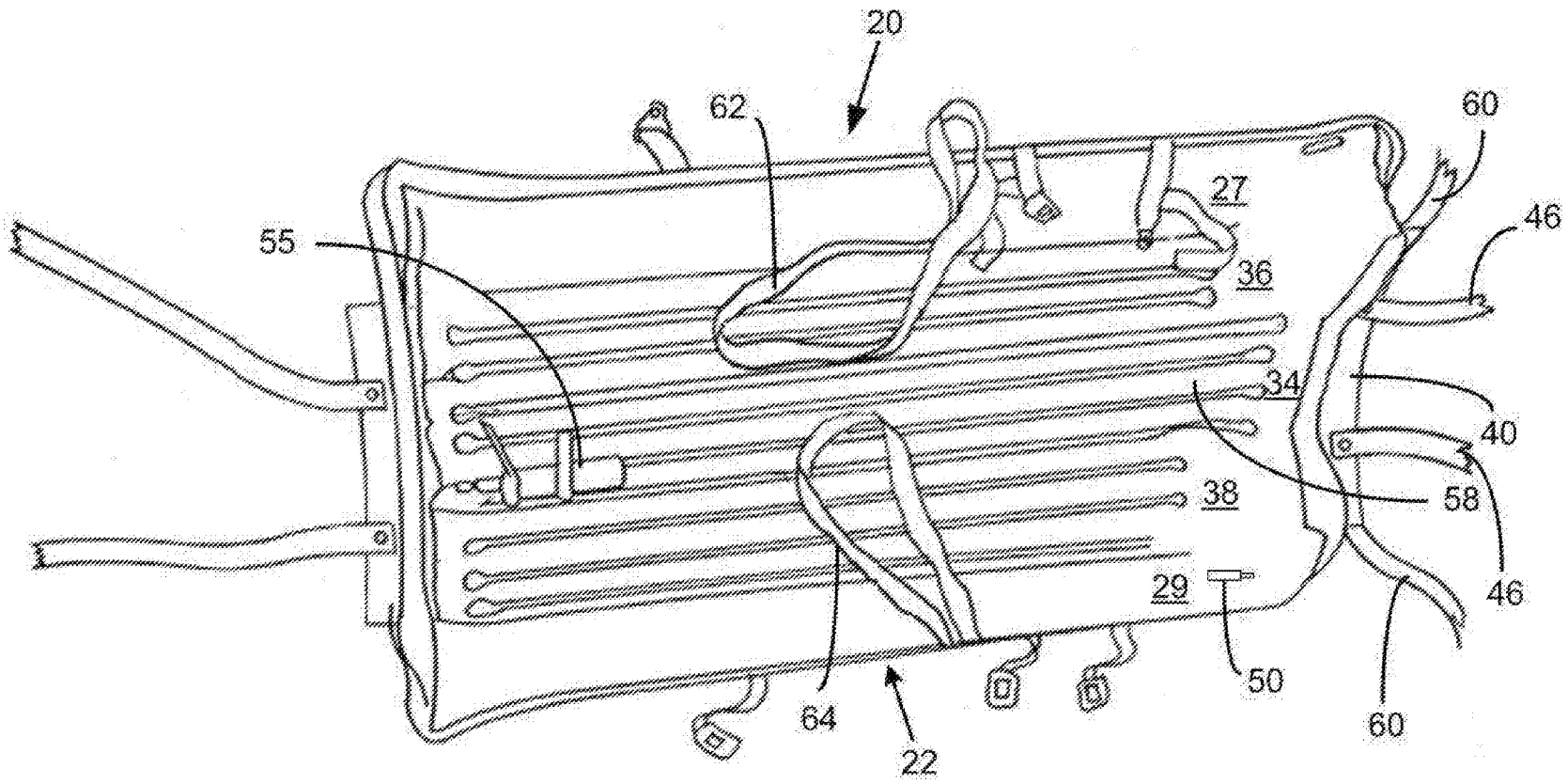
FIG. 7 is the same view as FIG. 2 but with the stretcher inflated.

Then the inflatable stretcher 10 is inflated by inserting gas through the gas inlet 50. The inflated stretcher 10 without the patient is shown in FIG. 7. When the stretcher 10 is inflated, and the patient's head is in the head support area 58, the head bumper chamber 34 abuts the top of the patient's head. This provides protection to the top of the head and serves as a locating mechanism to ensure that the patient is properly positioned before tightening the straps.

Figure 8:
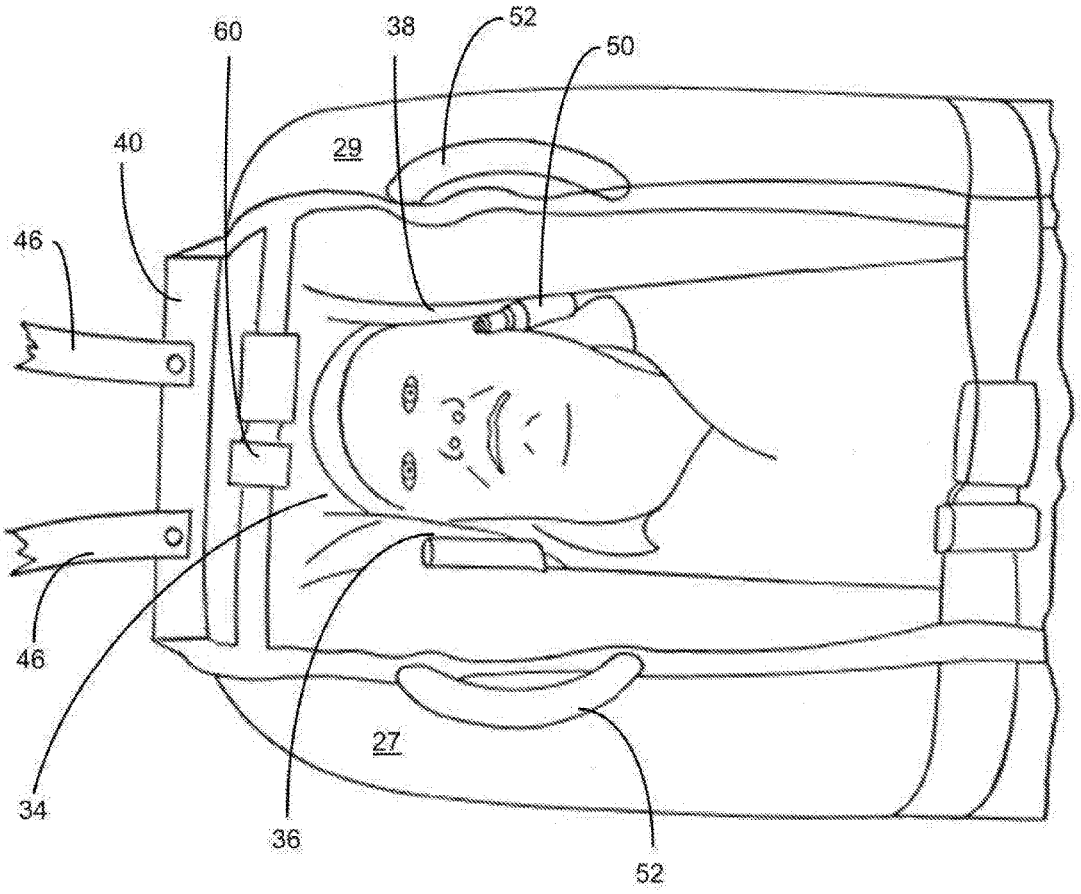
FIG. 8 is an enlarged portion of the head end of the patient and stretcher of FIG. 5 after the stretcher has been inflated and the straps have been secured and tightened.

Then, the body securement straps are buckled and tightened as shown in FIG. 1, pulling the side bumpers 27, 29 upwardly and inwardly toward each other and snugly wrapping the stretcher 10 around the patient. The head strap 60 is buckled and tightened, pulling the outer edges of the head immobilization chambers 36, 38 upwardly and together to press the head immobilization chambers 36, 38 against the sides of the patient's head, as shown in FIGS. 1 and 8. The leg straps 62, 64 are tightened as well.

This whole process takes about one minute. Then the inflatable stretcher 10, with the patient secured inside, is ready to be moved, by lifting the handles 52 or by pulling one of the pulling straps 46, 48, or both. The inflated stretcher 10 is stiff to provide support to the patient, and the inflated chambers provide cushioning to protect the patient from anything that may hit or bump against the stretcher 10. The head support area 58, head bumper chamber 34, and head immobilization chambers 36, 38, which are secured in position by the head strap 60, immobilize the patient's head and prevent the head from moving relative to the rest of the patient's body. When the patient is secured in the inflated stretcher 10 as shown in FIGS. 1 and 8, the patient is immobile. He cannot move his head, arms, or legs and cannot sit up or roll over.

While the dimensions and number of chambers may change in various embodiments, some features are preferable. For example, in order to provide the desired immobilization and protection for the patient, it is preferable for the side bumpers 27, 29 to have an inflated height that is at least 50% greater than the inflated height of the body support chambers 32 *a-i* and more preferable for the side bumpers 27, 29 to have an inflated height that is at least twice the inflated height of the body support chambers 32 *a-i*. It is preferable for the head immobilization chambers 36, 38 to have an inflated height that is at least 50% greater than the inflated height of the body support chambers 32 *a-i* and more preferable for the head immobilization chambers 36, 38 to have an inflated height that is at least twice the inflated height of the body support chambers 32 *a-i*. It is preferable for the head bumper chamber 34 to have an inflated height that is at least 30% greater than the inflated height of the body support chambers 32 *a-i* and more preferable for the head bumper chamber 34 to have an inflated height that is at least 50% greater than the inflated height of the body support chambers 32 *a-i*.

FIGS. 9-12 show a second embodiment of an inflatable stretcher 110, which is the same as the first embodiment 10 of FIGS. 1-10, except that ball transfer bearings 70 have been added below the layer 15 of UHMW material, in order to reduce friction when the inflatable stretcher 110 is being dragged along the ground. The top surface of the ball transfer bearings 70, which contacts the bottom surface of the inflatable stretcher 110, is planar, so it lies flat against the bottom surface of the inflatable stretcher. When the inflatable stretcher 110 is inflated, it is stiff enough, and the surface that supports the patient is raised above the elongated seams enough, that the ball transfer bearings 70 cannot be felt by the patient who is lying on top of the inflatable stretcher.

Figure 9:
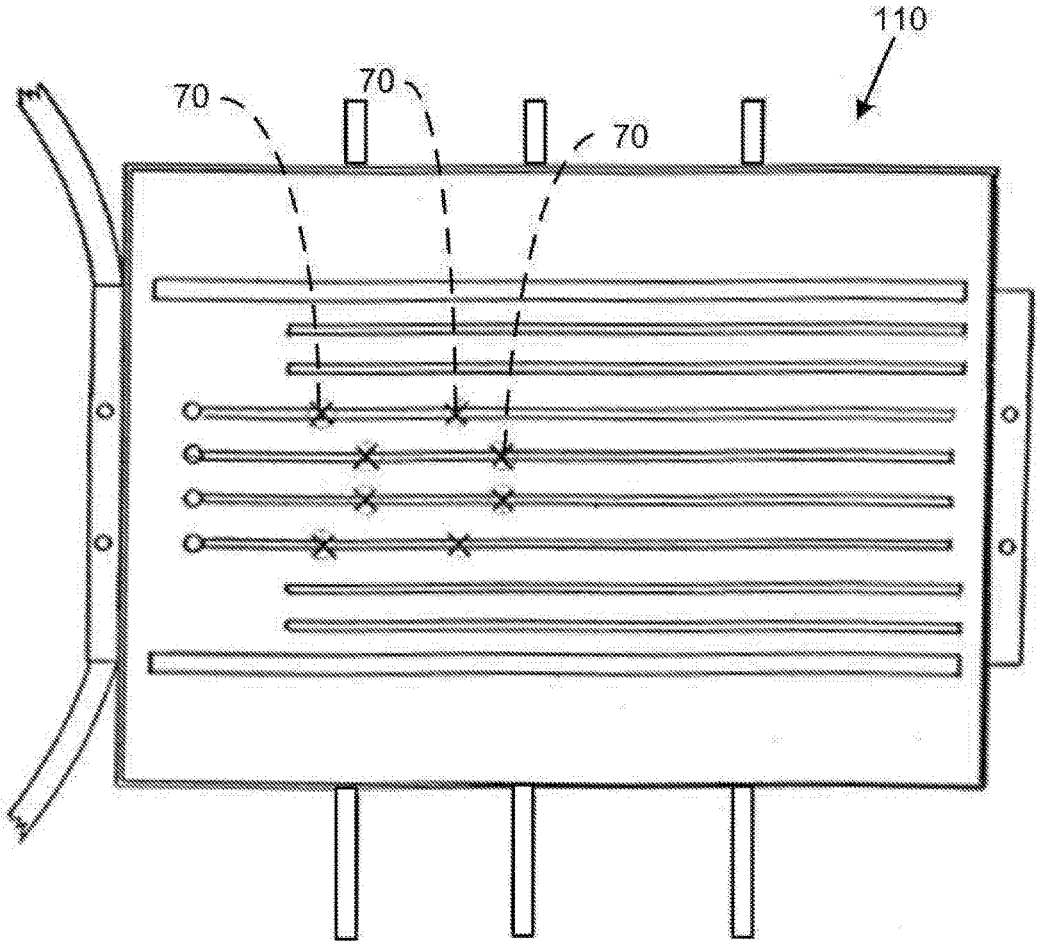
FIG. 9 is the same schematic view as FIG. 4 but for a second embodiment with ball transfer bearings on the bottom surface of the inflatable stretcher.

FIG. 9 is a schematic similar to FIG. 3 but with X's marked on the schematic to show the locations of the ball transfer bearings 70. The ball transfer bearings 70 are riveted in place by rivets 72 (see FIGS. 11 and 12) that are located along the central welded seams 30*c*, 30*d*, 30*e*, 30*f* (as identified in FIG. 3, see also FIG. 12), avoiding the inflated areas. The ball transfer bearings 70 are located in the areas of the inflatable stretcher that support the person's spine, shoulders, and hips.

Figure 10:
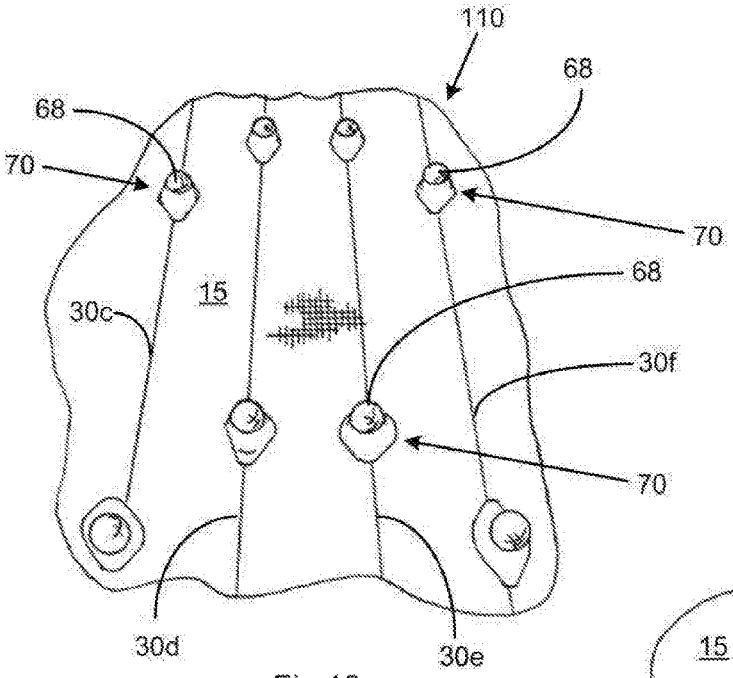
FIG. 10 is a broken-away, bottom view of the embodiment of FIG. 9, showing the ball transfer bearings on the bottom surface of the inflatable stretcher.

FIG. 10 is a broken-away perspective view of the bottom surface of the inflatable stretcher 110 showing the ball transfer bearings 70 of FIG. 9. In this view, and in FIG. 11, it can be seen that the ball transfer bearings 70 are flange mounted ball transfer bearings which include a nylon ball 68. The ball transfer bearings 70 in this particular embodiment are made by Hudson Bearings of Columbus, Ohio. The ball 68 in this ball transfer bearing 70 is not limited to rotation about a single axis. Since the nylon ball 68 can rotate about any axis, these bearings 70 reduce friction regardless of the direction in which the inflatable stretcher 110 is being dragged along the ground. There are openings in the flange area of the bearings 70 which receive the rivets 72 (shown in FIGS. 11 and 12), which secure the bearings 70 to the inflatable stretcher 110.

Figure 11:
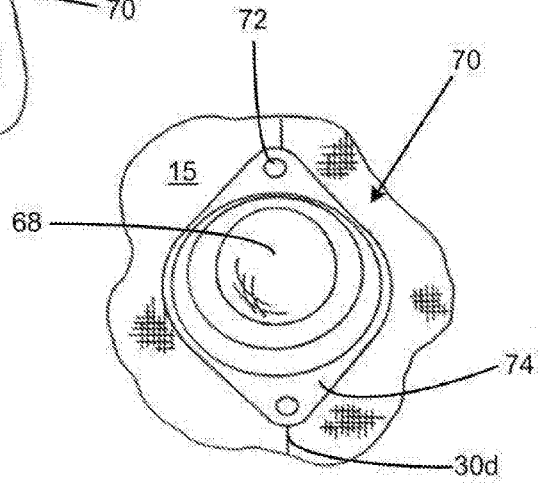
FIG. 11 is an enlarged view of one of the ball transfer bearings of FIG. 10.

FIG. 11 is an enlarged view of one of the ball transfer bearings 70, showing the flange 74, the nylon ball 68, and the rivets 72.

Figure 12:
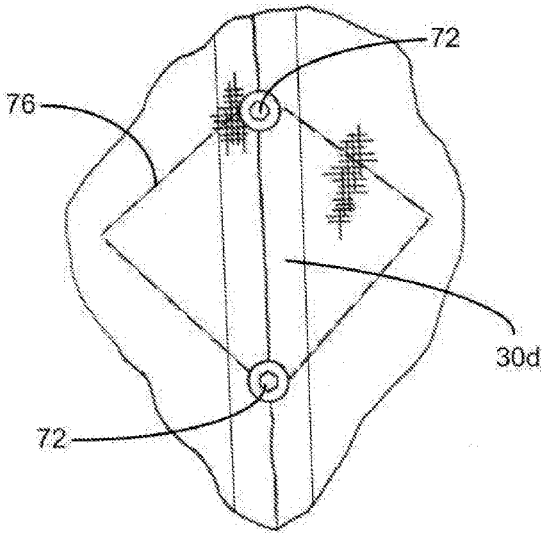
FIG. 12 is a top view of the area of the inflatable stretcher in which the ball transfer bearing of FIG. 11 is located, with lines added to indicate the location of welds in the area of the ball transfer bearing.

FIG. 12 is a top view of the area of the inflatable stretcher 110 where one of the ball transfer bearings 70 of FIG. 10 is mounted. It can be seen that the rivets 72 of this particular bearing 70 pass through the area of one of the central, elongated seams 30*d*. All the rivets 72 of all the bearings 70 pass through one of the respective seams 30, so the rivets 72 do not pierce any of the inflatable chambers. It also can be seen that an additional, diamond-shaped weld 76 has been made in the area of the ball transfer bearing 70 before mounting the bearing 70 onto the inflatable stretcher 110. This diamond-shaped weld 76 welds the upper and lower layers 12, 14 together and creates an area of the inflatable stretcher 110 directly above the planar top surface of the ball transfer bearing 70 that is sealed off and will not be inflated, thereby ensuring that the portion of the inflatable stretcher 110 directly above the ball transfer bearing 70 will remain flat, providing a stable mounting area for the flat top surface of the ball transfer bearing 70, even when the inflatable stretcher 110 is inflated.

It will be obvious to those skilled in the art that modifications may be made to the embodiments described above without departing from the scope of the invention as claimed.

What is claimed is:

1. An inflatable stretcher, comprising:

a lower layer of gas impermeable sheet material defining a head end, a foot end, a left side, and a right side, and having a lengthwise direction extending from said head end to said foot end and a widthwise direction extending from said left side to said right side;

an upper layer of gas impermeable sheet material secured to said lower layer around a perimeter and along a plurality of seams to define left and right elongated side bumper chambers extending lengthwise, along said left and right sides from said head end to said foot end, and a plurality of parallel, elongated body support chambers extending in said lengthwise direction interiorly of said left and right elongated side bumper chambers, and wherein said seams further define a central head support area adjacent to said head end, and left and right head immobilization chambers located on the left and right sides of said central head support area and interiorly of said left and right elongated side bumper chambers, each of said left and right head immobilization chambers defining an outer side edge adjacent to the respective side bumper chamber, wherein, when a gas is injected between said upper and lower layers of gas impermeable sheet material to inflate said sheet material to a fully inflated position, said body support chambers inflate to a first elevation, said elongated side bumper chambers inflate to a bumper chamber elevation which is greater than said first elevation; and said left and right head immobilization chambers inflate to a head immobilization chamber elevation which is greater than said first elevation;

and further comprising a plurality of body securement straps extending from said left side to said right side, wherein tightening said body securement straps pulls said left and right elongated side bumper chambers upwardly and toward each other; and a head securement strap extending adjacent to said head end and adjacent to said outer side edges of said left and right head immobilization chambers, wherein tightening said head securement strap pulls said outer side edges of said left and right head immobilization chambers upwardly and toward each other.

2. An inflatable stretcher as recited in claim 1, and further comprising a gas inlet opening defined in one of said upper and lower layers for injecting gas between said upper and lower layers, wherein said gas inlet opening is in fluid communication with said left and right elongated side bumper chambers, said body support chambers, said central head support area, and said left and right head immobilization chambers.

3. An inflatable stretcher as recited in claim 2, and further comprising a head bumper chamber adjacent to said head support area and offset from said head support area toward said head end, wherein, when a gas is injected between said upper and lower layers of gas impermeable sheet material to inflate said sheet material to a fully inflated position, said head bumper chamber inflates to a head bumper chamber elevation which is greater than said first elevation.

4. An inflatable stretcher as recited in claim 3, and further comprising a sheet of tough, low friction material secured beneath said lower layer of gas impermeable sheet material, said tough, low friction material being ultra high molecular weight polyurethane or another material having toughness similar to or tougher than ultra high molecular weight polyurethane and having a coefficient of friction similar to or lower than ultra high molecular weight polyurethane.

5. An inflatable stretcher as recited in claim 4, and further comprising a plurality of ball transfer bearings secured beneath said sheet of tough, low friction material, each of said ball transfer bearings including a ball rotatable about any axis.

6. An inflatable stretcher as recited in claim 5, wherein said ball transfer bearings are secured beneath said sheet of tough, low friction material by rivets extending through said upper and lower layers of gas impermeable sheet material and through said sheet of tough, low friction material, said rivets extending through a weld area in which said upper and lower layers of gas impermeable sheet material are welded together.

* * * * *